US007455104B2

(12) United States Patent
Duhon et al.

(10) Patent No.: US 7,455,104 B2
(45) Date of Patent: Nov. 25, 2008

(54) EXPANDABLE ELEMENTS

(75) Inventors: Mark C. Duhon, Sugar Land, TX (US); Simon L. Farrant, Houston, TX (US); Manish Kothari, San Mateo, CA (US); John M. Corben, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1613 days.

(21) Appl. No.: 09/871,240

(22) Filed: May 30, 2001

(65) Prior Publication Data

US 2002/0056553 A1 May 16, 2002

Related U.S. Application Data

(60) Provisional application No. 60/208,671, filed on Jun. 1, 2000.

(51) Int. Cl.
*E21B 36/00* (2006.01)
*E21B 43/10* (2006.01)

(52) U.S. Cl. ..... 166/57; 166/302; 166/206; 166/207

(58) Field of Classification Search ..... 166/57, 166/206, 207, 302
See application file for complete search history.

(56) References Cited

U.S. PATENT DOCUMENTS 1,917,135 A * 7/1933 Littell ..... 294/86.15
3,380,528 A * 4/1968 Timmons ..... 166/277
3,636,875 A * 1/1972 Dodson ..... 102/310
3,689,325 A * 9/1972 Hayden, Jr. et al. ..... 148/609
3,693,717 A * 9/1972 Wuenschel ..... 166/285
3,712,376 A * 1/1973 Owen et al. ..... 166/277
3,713,486 A * 1/1973 Meitzen ..... 166/285
3,812,912 A * 5/1974 Wuenschel ..... 166/207
4,042,019 A * 8/1977 Henning ..... 166/55
4,081,031 A * 3/1978 Mohaupt ..... 166/299
4,102,395 A * 7/1978 Robinson ..... 166/231
4,122,899 A * 10/1978 Brieger ..... 166/297
4,127,168 A * 11/1978 Hanson et al. ..... 166/123
4,151,875 A * 5/1979 Sullaway ..... 166/126
4,191,265 A * 3/1980 Bosse-Platiere ..... 175/4.56
4,257,245 A * 3/1981 Toelke et al. ..... 464/20
4,479,539 A * 10/1984 Tamplen et al. ..... 166/212

(Continued)

FOREIGN PATENT DOCUMENTS

GB 2330159 A 4/1999

(Continued)

OTHER PUBLICATIONS

Johsi, Amit, Introduction to Superplastic forming process, Nov. 2002, Indian Institute of Technology, Bombay, India.*

(Continued)

*Primary Examiner*—Shane Bomar
(74) *Attorney, Agent, or Firm*—Trop, Pruner & Hu, P.C.; Jeremy P. Welch; Bryan P. Galloway

(57) ABSTRACT

A method and apparatus includes providing an element formed of a superplastic material to perform a predetermined downhole task. In another arrangement, a method and apparatus includes a flowable element and a deformable element that can be expanded by flowing the flowable element.

9 Claims, 13 Drawing Sheets

U.S. PATENT DOCUMENTS

| | | | | | |
|---|---|---|---|---|---|
| 4,640,354 | A | | 2/1987 | Boisson | 166/250 |
| 4,662,288 | A | * | 5/1987 | Hastings et al. | 109/2 |
| 4,750,560 | A | * | 6/1988 | Gazda | 166/240 |
| 4,812,177 | A | * | 3/1989 | Maehara et al. | 148/505 |
| 4,817,716 | A | * | 4/1989 | Taylor et al. | 166/277 |
| 4,956,008 | A | * | 9/1990 | McQuilkin | 72/427 |
| 5,040,283 | A | | 8/1991 | Pelgrom | 29/447 |
| 5,131,470 | A | * | 7/1992 | Miszewski et al. | 166/297 |
| 5,172,948 | A | * | 12/1992 | Garnweidner | 293/133 |
| 5,322,127 | A | | 6/1994 | Mc Nair et al. | 166/313 |
| 5,337,823 | A | | 8/1994 | Nobileau | 166/277 |
| 5,348,095 | A | | 9/1994 | Worrall et al. | 166/380 |
| 5,366,012 | A | | 11/1994 | Lohbeck | 166/277 |
| 5,443,146 | A | * | 8/1995 | Ayyildiz et al. | 188/374 |
| 5,648,612 | A | * | 7/1997 | Takikawa et al. | 73/598 |
| 5,661,992 | A | * | 9/1997 | Sanders | 72/60 |
| 5,787,987 | A | | 8/1998 | Forsyth et al. | 166/313 |
| 5,941,313 | A | * | 8/1999 | Arizmendi | 166/387 |
| 5,979,560 | A | * | 11/1999 | Nobileau | 166/381 |
| 6,012,526 | A | | 1/2000 | Jennings et al. | 166/298 |
| 6,041,858 | A | * | 3/2000 | Arizmendi | 166/187 |
| 6,056,059 | A | * | 5/2000 | Ohmer | 166/313 |
| 6,056,835 | A | * | 5/2000 | Miyake et al. | 148/415 |
| 6,070,671 | A | | 6/2000 | Cumming et al. | 166/381 |
| 6,089,320 | A | * | 7/2000 | LaGrange | 166/313 |
| 6,109,355 | A | * | 8/2000 | Reid | 166/380 |
| 6,247,532 | B1 | * | 6/2001 | Ohmer | 166/50 |
| 6,250,385 | B1 | * | 6/2001 | Montaron | 166/207 |
| 6,331,218 | B1 | * | 12/2001 | Inoue et al. | 148/561 |
| 6,349,769 | B1 | * | 2/2002 | Ohmer | 166/313 |
| 6,401,815 | B1 | * | 6/2002 | Surjaatmadja et al. | 166/207 |
| 6,431,282 | B1 | * | 8/2002 | Bosma et al. | 166/207 |
| 6,454,001 | B1 | * | 9/2002 | Thompson et al. | 166/250.14 |
| 6,457,518 | B1 | * | 10/2002 | Castano-Mears et al. | 166/207 |
| 6,464,019 | B1 | * | 10/2002 | Werner et al. | 175/4.6 |
| 6,474,414 | B1 | | 11/2002 | Gonzalez et al. | |
| 2002/0060079 | A1 | * | 5/2002 | Metcalfe et al. | 166/207 |
| 2002/0079106 | A1 | * | 6/2002 | Simpson | 166/207 |
| 2002/0166668 | A1 | * | 11/2002 | Metcalfe et al. | 166/207 |
| 2003/0127225 | A1 | * | 7/2003 | Harrall et al. | 166/285 |
| 2006/0049234 | A1 | * | 3/2006 | Flak et al. | 228/112.1 |

FOREIGN PATENT DOCUMENTS

| | | | |
|---|---|---|---|
| JP | 3288000 | A | 12/1991 |
| JP | 4083099 | A | 3/1992 |

OTHER PUBLICATIONS

Hirano et al., Extra Low Carbon Age-Hardenable Alloys For Tubular Application in Oil and Gas Industry, 1994, pp. 775-786.*

Kolts, Juri, Alloy 718 For the Oil and Gas Industry, 1989, pp. 329-344.*

Bhavsar, Rashmi B, Use of Alloy 718 and 725 in Oil and Gas Industry, 2001, pp. 47-55.*

Smith et al., Superplastic Forming of Inconel Alloy 718SPF, 1994, 355-364.*

Peyroutou et al., Characterization of Alloy 718 Microstructures, 1991, pp. 309-324.*

Ingentaconnect, Superplastic forming of alloy 718, Smith, et al. 1995, pp. 337-377(1) http://www.ingentaconnect.com/content/els/01421123/1995/00000017/00000005/art99763.*

* cited by examiner

EXPANDABLE ELEMENTS

CROSS-REFERENCE TO RELATED APPLICATION

This application claims the benefit under 35 U.S.C. § 119 to U.S. Provisional Patent Application Ser. No. 60/208,671, entitled "EXPANDABLE ELEMENTS," filed on Jun. 1, 2000.

TECHNICAL FIELD

The invention relates to expandable elements for performing various operations.

BACKGROUND

Many different tasks may be performed in a wellbore. For example, perforating guns may be shot to create perforations in a target formation to produce well fluids to the surface. Different zones in a wellbore may be sealed with packers. Plugs may be set at desired depths to isolate portions of a wellbore. A casing patch may be activated to patch openings in a casing or other type of liner. Sand screens may be installed to control production of sand. In addition to completion equipment, other tools for use in wellbores may include drilling equipment, logging equipment, and so forth.

The tools for performing the various operations may include many different types of elements. For example, the tools may include explosives, sealing elements, expandable elements, tubings, casings, and so forth. Operation, translation, actuation, or even enlargement of such elements may be accomplished in a number of different ways. For example, mechanisms that are electrically triggered, fluid pressure triggered, mechanically triggered, and explosively triggered may be employed. Although improvements in downhole technology has provided more reliable and convenient mechanisms for operating, translating, actuating, or performing other tasks with downhole elements, a need continues to exist for further improvements in such mechanisms.

SUMMARY

In general, according to one embodiment, an apparatus for use in a wellbore, comprises an element formed of a superplastic material to perform a predetermined downhole task.

In general, according to another embodiment, an apparatus comprises a flowable element and a deformable element adapted to be expanded by flowing the flowable element.

In general, according to yet another embodiment, a method of installing a tubular structure into a wellbore comprises running the tubular structure having a reduced diameter into the wellbore, and activating a heating element to heat at least a portion of the tubular structure to enable the tubular structure to exhibit a highly deformable characteristic while maintaining structural integrity. The diameter of the tubular structure is expanded.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. For example, although the described embodiments include equipment for use in downhole applications, further embodiments may include equipment for surface applications.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In accordance with some embodiments of the invention, tools containing an expandable element are used to perform various operations or tasks. For example, the expandable element may be used to provide a seal, a plug, a packer, a patch, an expandable tubing or casing, an anchor, a tubing hanger, and so forth. In one embodiment, the expandable element includes a highly deformable material that in one embodiment is made of a superplastic material. A superplastic material exhibits high elongation or deformation without fracturing or breaking. The superplastic material may be a metal (such as aluminum, titanium, magnesium, or other light metals), a ceramic, or some other suitable material. Some superplastic materials may exhibit superplastic characteristics at about 95% to 100% of the melting temperature of the material. Other superplastic materials may exhibit superplastic characteristics at other temperature ranges, such as grater than about 50% of the melting temperature. Thus, depending on the desired application, the superplastic material selected may be one that exhibits superplastic characteristics at a desired temperature range. In further embodiments, other highly deformable materials that exhibit the desired deformation characteristics at a selected temperature while still maintaining structural integrity (e.g., without breaking or fracturing) may be used.

A superplastic material is a polycrystalline solid that has the ability to undergo large uniform strains prior to failure. For deformation in uni-axial tension, elongation to failure in excess of 200% are usually indicative of superplasticity. For superplastic behavior, a material must be capable of being processed into a fine equi-axed grain structure that will remain stable during deformation. The grain size of superplastic materials are made as small as possible, normally in the range of 2 to 10 micrometers, although materials with larger grain sizes may also exhibit superplasticity.

Figure 1:
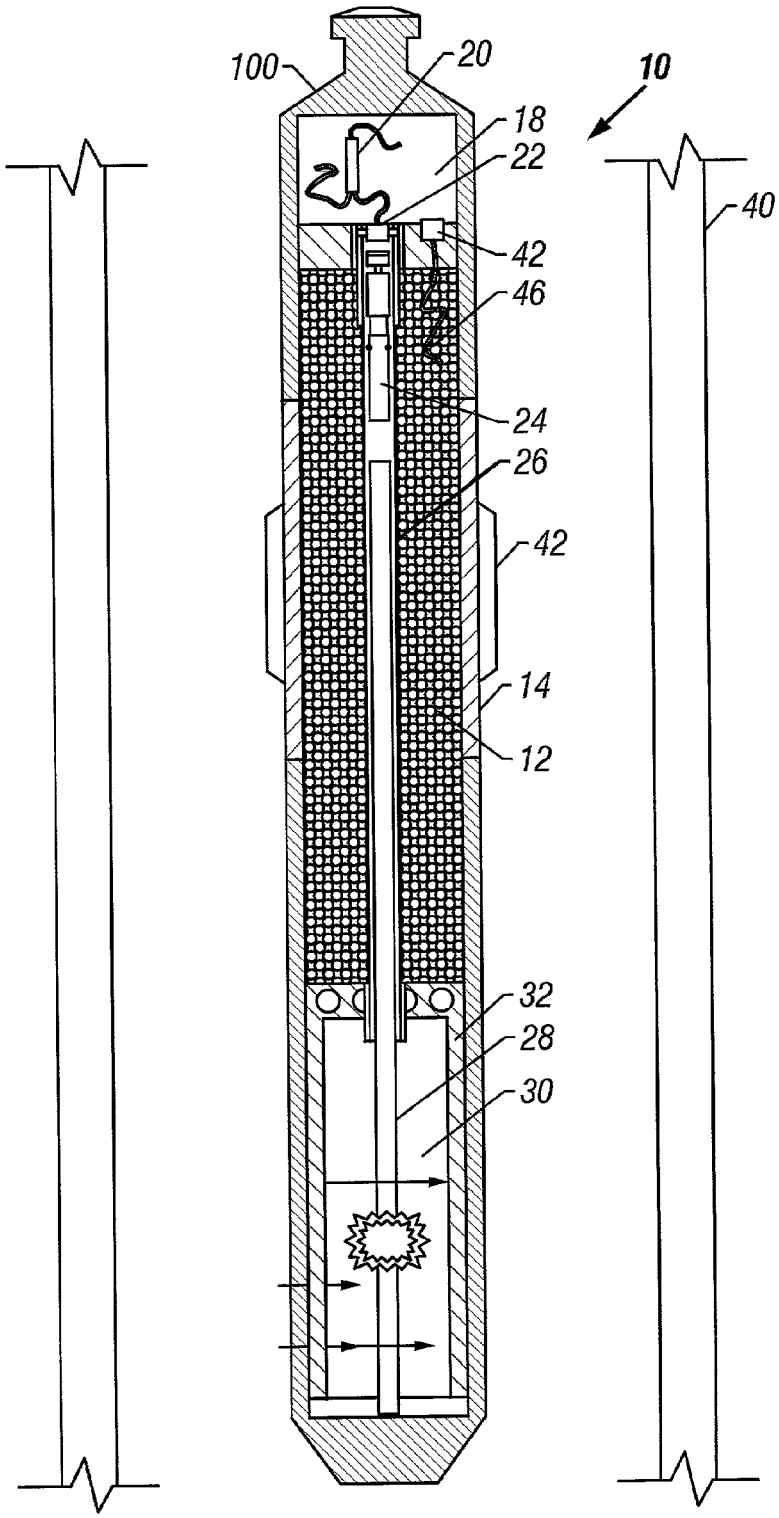
FIG. 1 illustrates an embodiment of a plug tool in a run-in position.

Referring to FIG. 1, in one embodiment, an expandable plug 10 includes a "flowable" element 12 and an expandable element 14 formed at least in part of a superplastic material. The flowable element 12 is initially in solid form inside a housing 16 of the expandable plug 10. When heated, the flowable element 12 transitions to a molten or liquid state. The expandable element 14 is in the form of a sleeve attached to the housing 16 at the upper and lower ends of the sleeve 14.

In one embodiment, the flowable element 12 may include a eutectic material. In other embodiments, the flowable element 12 may include a solder, a fusible alloy, or a blocking alloy. A fusible alloy is a low melting temperature composition containing bismuth, lead, tin, cadmium, or indium. A blocking alloy is a high purity, low melting temperature alloy. The eutectic material, solder, fusible alloy, and blocking alloy exhibit volume expansion when transitioning from a molten or liquid state to a solid state. A eutectic material generally melts and solidifies at the same temperature. On the other hand, some of the other types of materials may have a first temperature at which they transition from a solid state to a molten or liquid state and a second temperature at which they transition from a molten or liquid state to a solid state. Generally, the first temperature is higher than the second temperature. Due to desired characteristics of bismuth, many of the alloys used to form the flowable element 12 that may be used in various applications may contain bismuth along with other elements. The flowable element 12 can also be formed entirely of bismuth. Possible flowable materials are listed in the attached Appendix A.

The flowable element 12 has a predetermined temperature at which it transitions from the solid to a molten or liquid state. To actuate the plug 10, the flowable element 12 is raised to above this predetermined temperature. To allow cooperation between the flowable element 12 and the expandable element 14, the expandable element 14 is made of a superplastic material that exhibits superplastic characteristics at about the same temperature as the predetermined flow temperature of the flowable element 12. This allows the flowable element 12 to be displaced to deform the superplastic sleeve 14 to form the desired plug inside a casing, liner, tubing, or pipe 40.

As further shown in FIG. 1, the expandable plug 10 includes a cap 100 defining an atmospheric chamber 18 through which electrical wiring 20 is routed. The electrical wiring 20 is connected through a sealed adapter 22 to an igniter 24. The adapter 22 provides a sealed path through a bulkhead of the expandable plug 10. The igniter 24 is fitted with an O-ring seal to isolate the atmospheric chamber 18. A thermosensor 46 is also attached through the bulkhead to sense the temperature of the flowable element 12. A connector 42 attached to the thermosensor 46 may be connected to electrical wiring (not shown) that extends to the surface so that a well surface operator can monitor the temperature of the flowable element 12.

In the illustrated embodiment, the igniter 24 is placed in the upper portion of a tube 26, which may be formed of a metal such as steel. Below the igniter 24 is a propellant stick 28 that can be initiated by the igniter 24. The propellant stick 28 runs along the length the tube 26 into a chamber 30 formed inside a power piston 32.

The power piston 32 is moveable inside the housing 16 of the expandable plug 10 in response to pressure generated in the chamber 30. The power piston 32 is moveable in an upward direction to apply pressure against the flowable element 12. The lower end of the housing 16 terminates in a bull plug bottom 34. When in solid form, the flowable element 12 prevents movement of the power piston 32.

A sealing element 43 is formed on the outside surface of the superplastic sleeve 14. The sealing element 43, which may be formed of an elastomer, is designed to engage the inner wall of the casing, liner, tubing, or pipe 40 to isolate the wellbore above and below the expandable plug 10.

Figure 2:
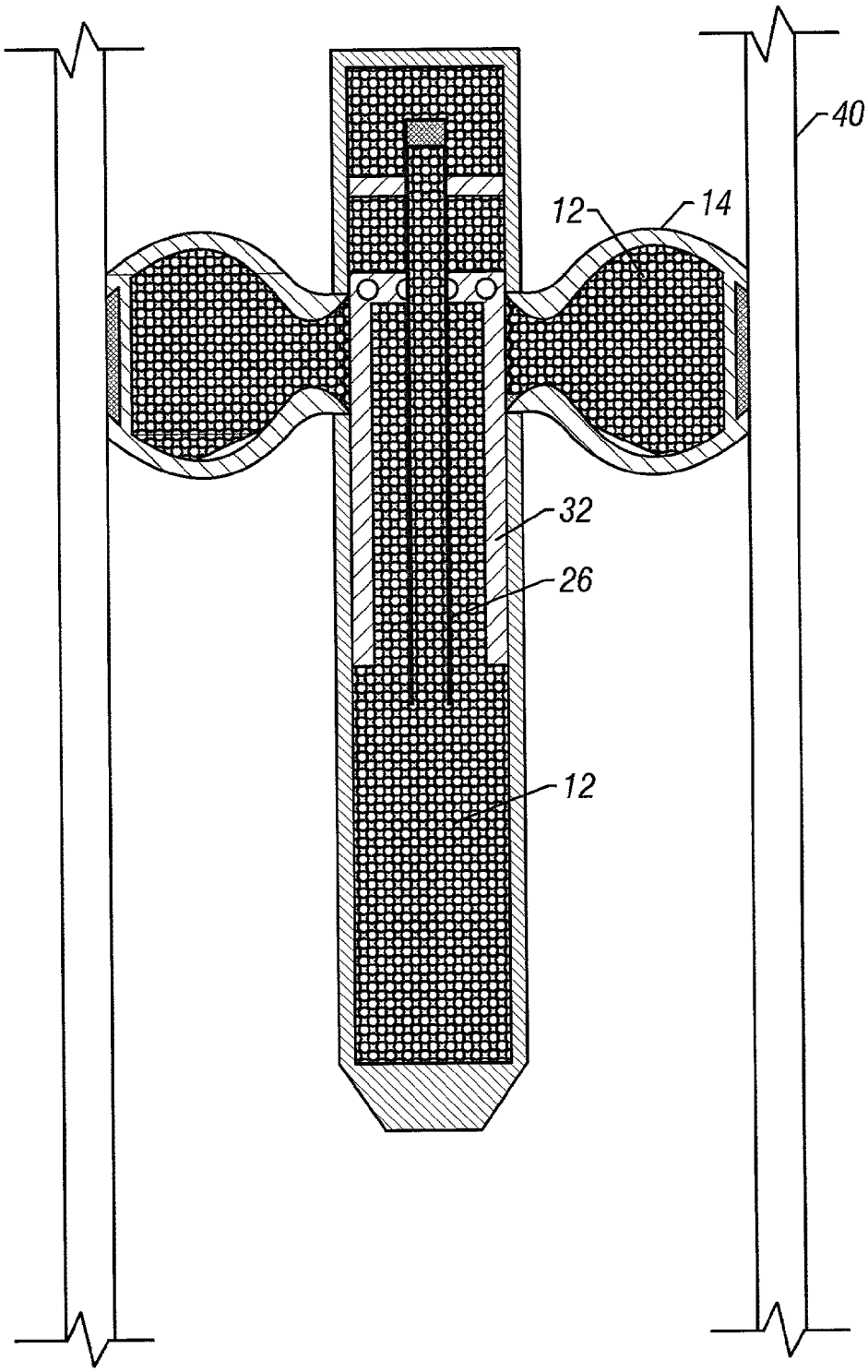
FIG. 2 illustrates the plug tool of FIG. 1 in a set position.

In operation, to set the expandable plug 10, a survey may be initially performed with a surveying tool (not shown) to determine the temperature and pressure of the wellbore at the desired depth. Once the temperature and pressure has been determined, the surveying tool may be pulled out of the hole and the expandable plug 10 lowered into the wellbore. When the expandable plug 10 is lowered to a desired depth, some time is allowed for the plug 10 to equalize to the temperature of the wellbore. The setting process is then started by firing the igniter 24, which initiates the propellant stick 28 to create heat and to generate gas in the chamber 30. The increase in pressure in the chamber 30 creates a differential pressure across the power piston 32, whose other side is at atmospheric chamber. Due to the increased heat, the expandable element 12 becomes molten. As a result, the resistance against movement of the power piston 32 is removed so that the gas pressure in the chamber 30 pushes the power piston 32 upwardly. The molten element 12 is displaced and expands to deform the sleeve 14, which due to the increased temperature is now exhibiting superplastic characteristics. As best shown in FIG. 2, the sleeve 14 radially deforms outwardly by force applied by the power piston 32 so that the sealing element 43 is pressed against the inner wall of the casing 40.

After full displacement, the power piston 32 engages a ratchet lock (not shown) to maintain its up position as shown in FIG. 2. Some amount of the flowable element 12 still remains above the power piston 32. At this point, the propellant stick 28 has burned out, so that the temperature within the expandable plug 10 starts to decrease. The temperature of the flowable element 12 as monitored by the thermosensor 46 is communicated to the surface. The surface operator waits until the temperature stabilizes in the expandable plug 10.

As the flowable element 12 cools and transitions from a molten or liquid state to a solid state, the element 12 expands in volume during the phase change. The volume expansion creates a radially acting force to increase the force applied against the sealing element 42 that is in contact with the casing inner wall of the casing, liner, tubing, or pipe 40.

The volume expansion of the flowable element 12 that is located above the power piston 32 inside the cap 100 also applies a radial force against the inner wall of the cap 100. As further described below in connection with FIGS. 3 and 4, this outward radial force applied against the cap 100 causes a release of the cap 100 from the rest of the expandable plug 10. This allows the cap 100 and the carrier line attached to the cap 100 to be retrieved from the well after the plug 10 has been set.

Figure 4:
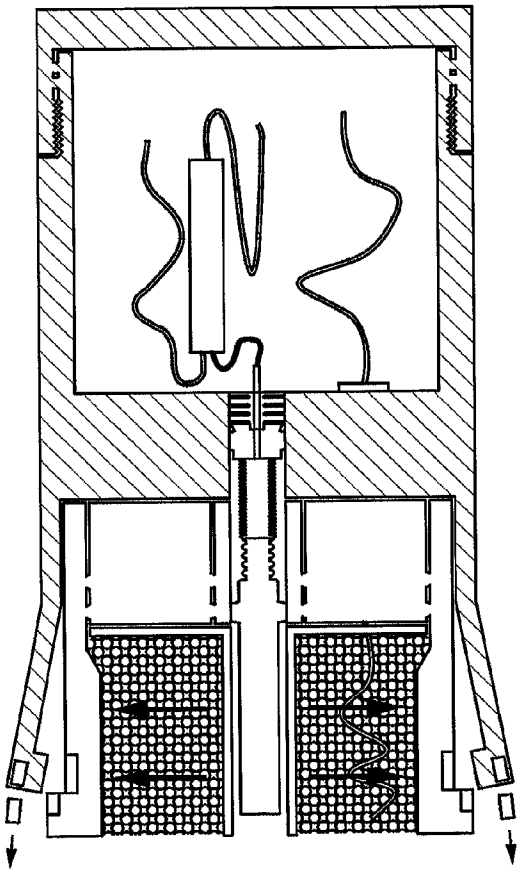
FIGS. 3 and 4 illustrate a release mechanism in the plug tool of FIG. 1 in accordance with an embodiment.
Figure 3:
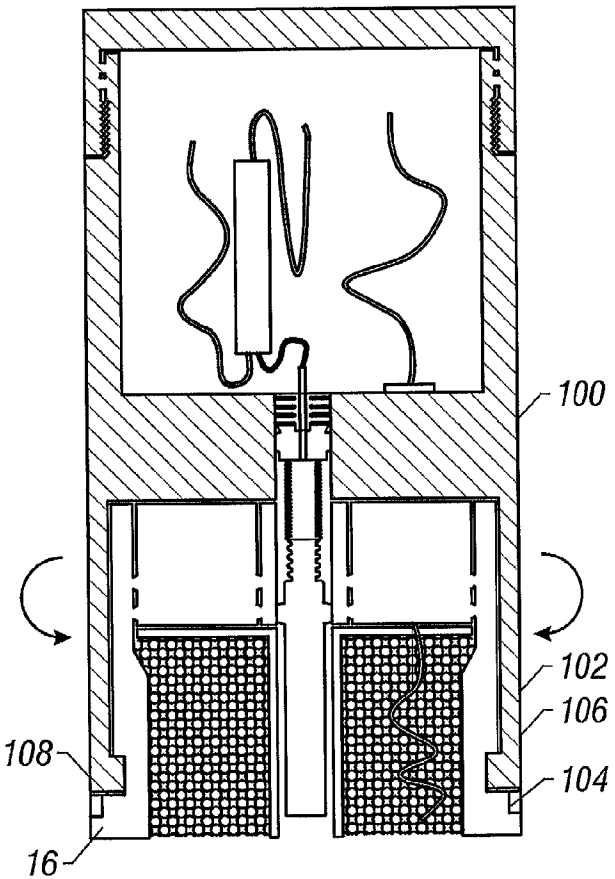

Referring to FIGS. 3 and 4, the release mechanism of the expandable plug 10 is illustrated. The upper cap 100 is attached to a collet 102. The collet 102 has a protruding portion 104 that is engaged in a groove 106 of the housing 16. The collet 104 is maintained in engagement in the groove 106 by a frangible ring 108, which may be formed of a ceramic or other suitably frangible material.

When the flowable element 12 in the upper portion of the housing 16 cools and transitions from a molten or liquid state to a solid state, it expands in volume to create an outward radial force against the inner wall of the housing 16. Application of a sufficient force pushes the housing 16 and the collet 102 radially outwardly so that the frangible ring 108 breaks. When the frangible ring 108 breaks, the collet 102 can disengage from the groove 106 so that the upper head of the expandable plug 10 can be retrieved to the well surface, leaving the plug 10 formed of the flowable element 12 and superplastic sleeve 14 behind.

In accordance with some embodiments of the invention, to achieve a material having superplastic characteristics, an extrusion process may be performed on the material. Extrusion refers to a process in which a large plastic deformation is induced in the material without changing the size or general shape of the material. In one embodiment, the desired material, which in this case may be a sleeve, is passed through two intersecting channels of only slightly larger dimensions. The angle can be chosen between 0 and 90° to provide a varied amount of strain. As the material passes the turn between the intersecting channels, the material must shear. Extrusion allows the grain size of the material to be reduced to a micron or submicron range to enhance the elasticity of the material. One example material that may be subjected to the extrusion process to achieve superplastic characteristics is AZ91, which includes a composition of magnesium, aluminum and zinc. The formula for AZ91 is 90Mg9Al1Z. In addition to reducing grain size, the grain size also becomes more uniform after the extrusion process, which enables a processed metal to distort and flow without splitting or fracturing due to stress concentrations.

Figure 7:
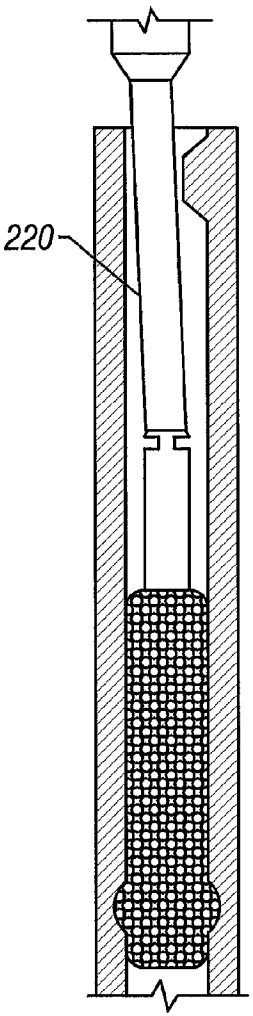
FIGS. 5-7 illustrate a pipe fishing tool in accordance with an embodiment.
Figure 6:
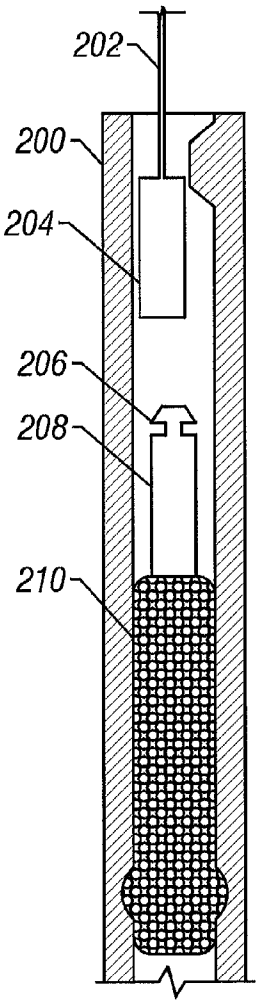
Figure 5:
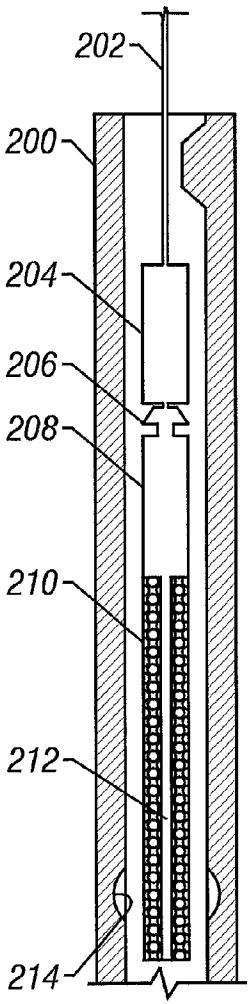

Referring to FIGS. 5-7, another application of a highly deformable material such as a superplastic material is in downhole fishing operations. As shown in FIG. 5, a tubing or pipe 200 is to be retrieved to the well surface. A fishing tool, which may be lowered by a wireline, slickline, or coiled tubing 202, is lowered into the inner bore of the tubing or pipe 200. The carrier line 202 is attached to a cable head 204, which in turn is coupled to a fishing head 206 that is attached to a firing head 208. A detonating cord 210 extends from the firing head 208 into a sleeve 212, which may be perforated. The sleeve 212 may be formed of a highly expandable metal alloy that exhibits superplastic behavior at an elevated temperature.

An internal upset 214 is provided in the inner wall of the tubing or pipe 200. In operation, the fishing tool is lowered into the inner bore of the tubing or pipe 200 to a position proximal the upset 214, as shown in FIG. 5. The firing head 208 is then activated to ignite the detonating cord 212. Heat and pressure generated by initiation of the detonating cord 210 causes the sleeve 212 to expand. A portion of the sleeve 212 expands into the upset 214 to provide a move secure engagement of the sleeve 212 with the tubing or pipe 200. Once the sleeve 212 has been expanded into engagement with the tubing or pipe 200, the cable head 204 is detached from the fishing head 206 and raised by the carrier line 202, as shown in FIG. 6.

Next, as shown in FIG. 7, a work string having a stinger 220 is lowered into the wellbore. The stinger 220 is passed into the bore of the tubing or pipe 200 for engagement with the fishing head 206. Once engaged, the work string can be raised to raise the entire assembly including the fishing tool and the tubing or pipe 200.

Figure 8:
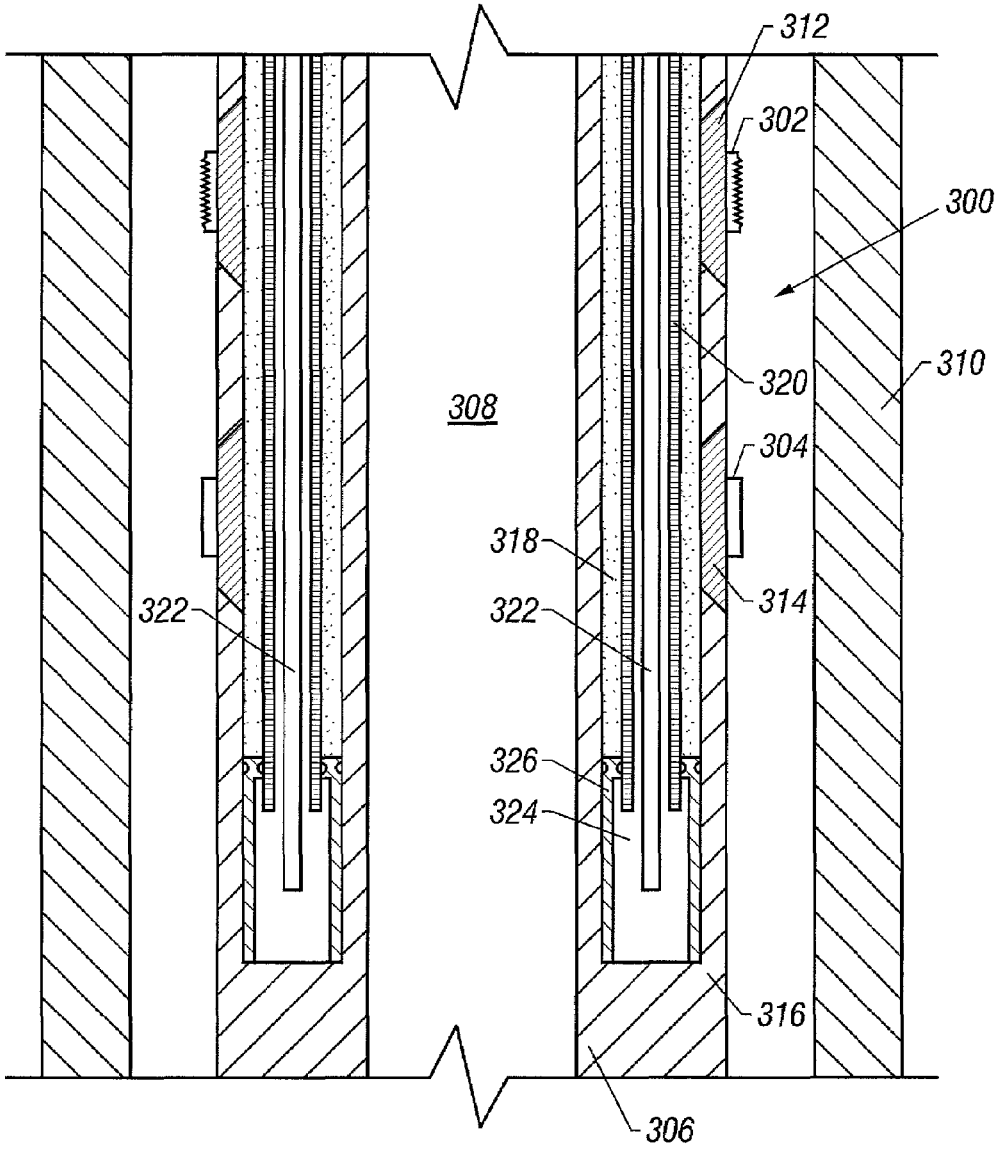
FIG. 8 illustrates a packer in accordance with an embodiment.

Referring to FIG. 8, a packer 300 in accordance with one embodiment is illustrated. The packer 300 includes an anchor slip or element 302 and a sealing element 304, which may be formed of an elastomeric material. Both the sealing element 304 and the anchor element 302 may be translated radially into engagement with an inner wall of a casing or liner 310. This isolates an annular region formed between an inner tubing or pipe 306 of the packer 300 and the casing 310. However, flow through the packer 300 is still possible through an inner bore 308 of the tubing or pipe 306.

The anchor element 302 is attached on the outside of a highly deformable sleeve 312, and the sealing element 304 is formed on the outside of a highly deformable sleeve 314. Each of the highly deformable sleeves 312 and 314 may be formed of a superplastic material that exhibits a superplastic behavior in a predetermined temperature range. The highly deformable sleeves are attached to the housing 316 of the packer 308.

A space is defined inside the housing 316 of the packer 300 in which a flowable element 318 may be located. The flowable element, initially in solid form, is in contact with the inner surfaces of both expandable sleeves 312 and 314 in the illustrated embodiment. An annular tube 320 runs in the region formed inside the housing 316 of the packer 300. A propellant 322 (or multiple propellants) may be placed inside the annular tube 300.

The propellant 322 extends into an annular space 324 defined within a piston 326. The piston 326 is movable upwardly by application by pressure inside the chamber 324 once the flowable element 318 transitions from a solid to a molten or liquid state.

In an activating mechanism that is similar to that of the plug 10 in FIGS. 1 and 2, the propellant 322 may be ignited to generate heat to melt the flowable element 318 and to create high pressure inside the chamber 324. Once the flowable element 318 melts, the pressure inside the chamber 324 pushes the power piston 326 upwardly to displace the highly deformable sleeves 312 and 314, which pushes the anchor elements 302 and the sealing element 304 into contact with the inner wall of the casing 310.

Once the propellant 322 has burned out, the temperature of the flowable element 318 starts to cool, which enables the flowable element 318 to transition from a molten or liquid state back to a solid state. The transition back to the solid state causes the volume of the flowable element 318 to expand, which applies a further radial force against the highly deformable sleeves 312 and 314 to further engage the anchor element 302 and the sealing element 304 against the inner wall of the casing 310.

Once set, the packer 300 isolates the annular region between a pipe or tubing and the casing 310. The pipe or tubing maybe arranged concentrically within the casing 310, and may include a production tubing or injection tubing.

In another application, a tool similar in design to that of the packer 300 may be employed as a patching tool. A patching tool is used to patch portions of a casing or liner that may have been damaged or that may have been previously perforated. In one example, a formation that was previously producing hydrocarbons may start to produce water or other undesirable fluids. When that occurs, a patching tool may be used to patch the perforations formed in the casing or liner to prevent further production of fluids from the formation.

To implement such a patching tool in accordance with some embodiments of the invention, the tool 300, shown in FIG. 8, may be modified to include a patch in place of the anchor element 302 and the sealing element 304. The patch may be formed of an elastomer, which is similar to the sealing element 304 of FIG. 8. However, to provide a larger coverage area, the patch may be formed of a larger piece of material. The patch may be arranged on the outer surface of a highly deformable sleeve, which may be made of a superplastic material. The patching tool may include an inner bore much like the inner bore 308 shown in FIG. 8 to allow fluid flow even after the patch has been set in the wellbore.

Another embodiment may include a patching tool used in open holes rather than cased or lined holes. Such a patching tool may include a patch made of a metal or other suitable material that can be pressed into contact with the inner wall of the open hole.

Figure 9:
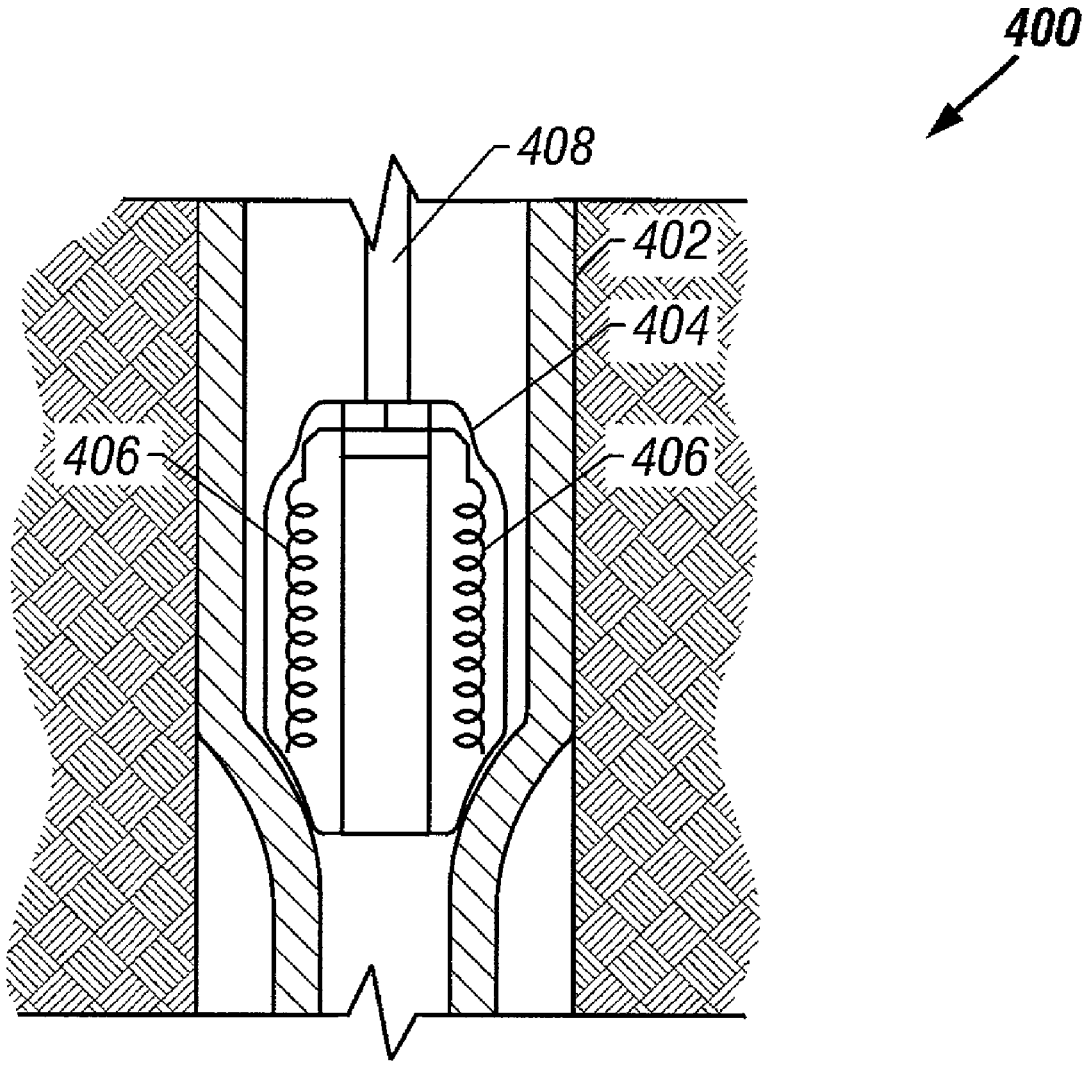
FIG. 9 illustrates an expandable casing assembly in accordance with an embodiment.

Referring to FIG. 9, an expandable casing or liner assembly 400 is illustrated. The expandable casing or liner assembly includes a casing or liner 402 that is formed of a highly deformable material, which may be a superplastic material. The casing or liner 402 may be run into a wellbore with a diameter that is smaller than the inner diameter of the wellbore. To expand the diameter of the casing or liner 402, an expander tool 404 may be run into the inner bore of the casing or liner 402. The outer diameter of the expander tool 404 is the desired inner diameter of the casing or liner 402. The expander tool 404 may be pushed downwardly by a carrier line 408. To provide structural rigidity, the carrier line 408 may be tubing or pipe.

The highly deformable casing or liner 402 exhibits superplastic behavior at a predetermined temperature range. Thus, to ease the expansion of the casing or liner 402, the expander tool 404 contains a heating element, which may include resistive heating elements 406, to heat the adjacent casing or liner 402 to a desired temperature range. Thus, when the expander tool 404 heats the adjacent casing or liner 402 to a sufficiently elevated temperature, the casing or liner 402 becomes superplastic, making the expansion process more convenient. Further, due to the superplasticity of the casing or liner 402, likelihood of breakage or fractures of the casing or liner 402 is reduced.

A similar process may be applied to expanding a tubing or pipe formed of a superplastic material or other highly deformable material that exhibits high deformability at an elevated temperature while still maintaining structural integrity.

In another embodiment, instead of running the expander tool 404 downwardly, the expander tool 404 may be positioned at the lower end of the casing or liner 402 and run with the casing or liner 402 into the wellbore. To perform the expansion process, the expander tool 404 may be raised through the inner bore of the casing or liner 402 to expand the casing or liner 402.

Figure 10:
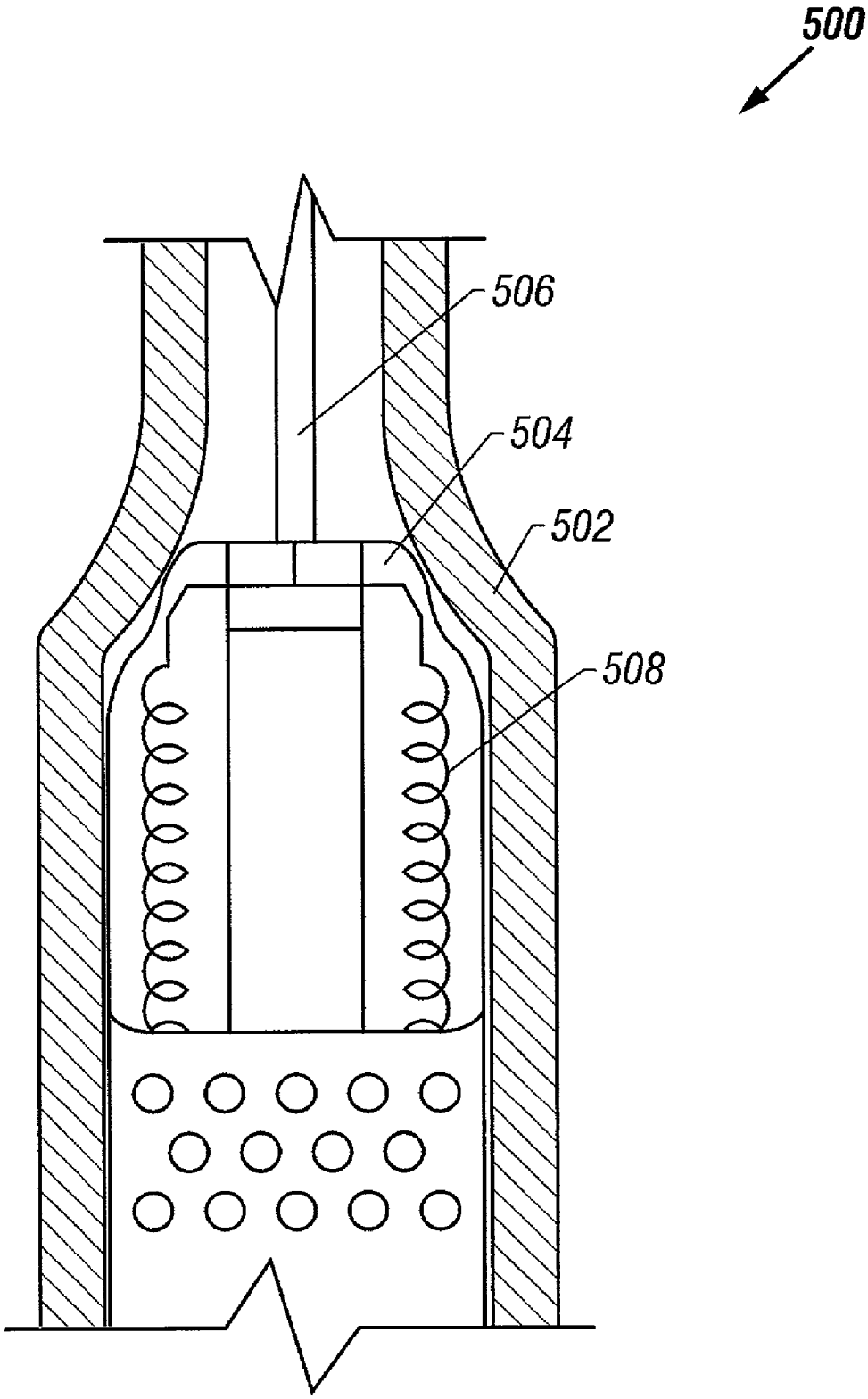
FIG. 10 illustrates an expandable screen assembly in accordance with an embodiment.

Referring to FIG. 10, an expandable screen assembly 500 is shown. The screen assembly 500 may include a screen 502 that is used for sand control, as an example. A screen 502 typically includes a pattern of openings to provide the desired flow characteristics so that sand may be blocked while desired hydrocarbons are produced into the wellbore.

In the embodiment of FIG. 10, the screen 502 is formed of a highly deformable material, such as a superplastic material. The screen assembly 500 may be installed inside a wellbore with an expander tool 504 positioned below the expandable screen 502. When the screen assembly 500 is positioned at a desired depth, an electrical signal may be run through an electrical cable in the carrier line 506 to heat up resistive heating elements 508. This allows the expander tool 504 to heat the adjacent portion of the expandable screen 502 to a temperature at which the screen 502 exhibits superplastic behavior. This enables the expander tool 504 to be raised to expand the diameter of the screen 502, which may bring it into contact with the inner wall of an open hole. By bringing the sand screen 502 into closer proximity to the inner wall of an open hole, better sand control may be provided. Also, by employing a superplastic material that is heated to enable expansion of the screen 502, the likelihood of damage to the screen 502 during the expansion process may also be reduced because of the superior structural integrity of superplastic materials.

Figure 11:
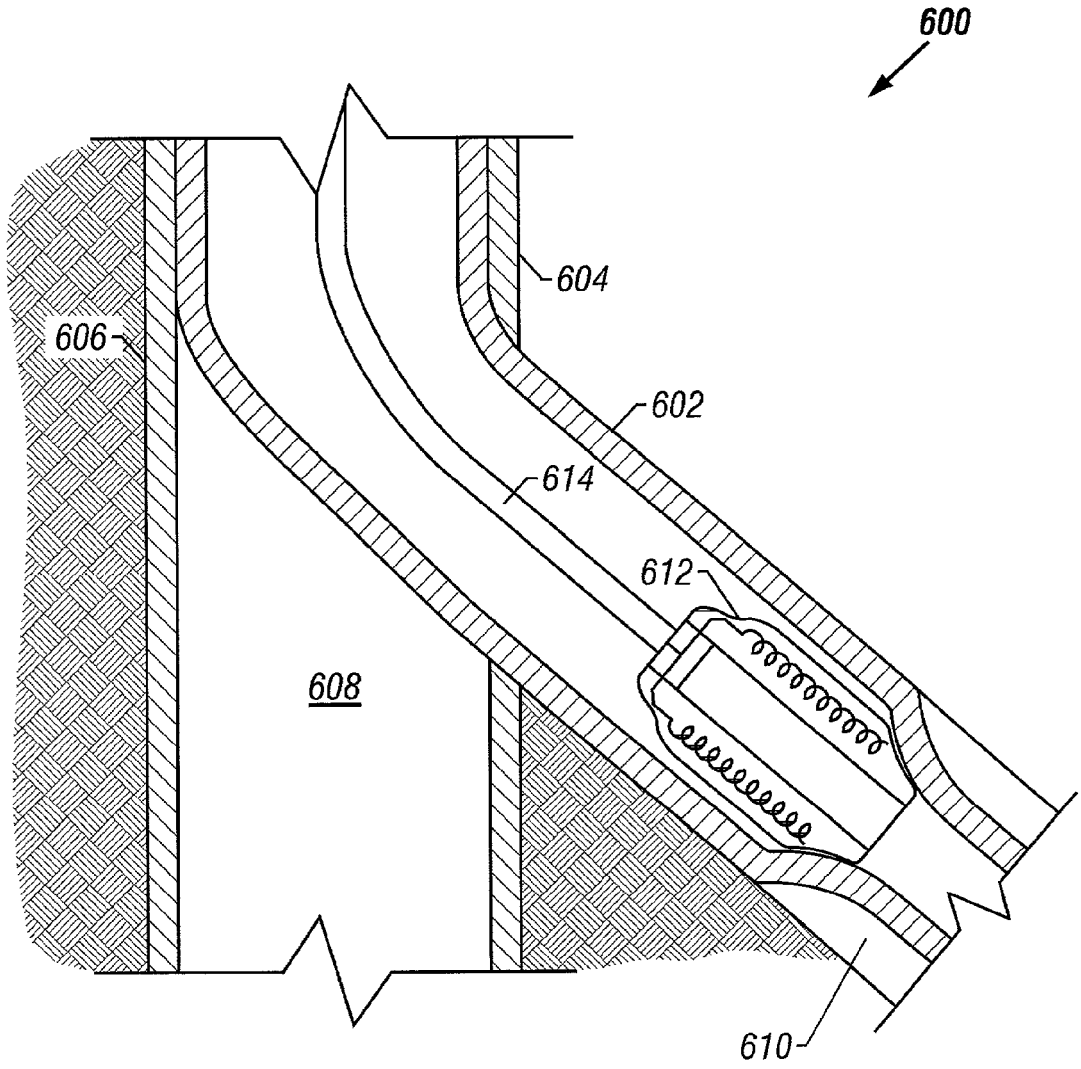
FIG. 11 illustrates a junction seal assembly in accordance with an embodiment for use in a lateral junction.

Referring to FIG. 11, a multi-lateral junction assembly 600 is illustrated. The lateral junction assembly 600 includes a tubing 602 that is formed of a highly deformable material that may be inserted through a window 604 milled through the side of a casing or liner 606 to expose the main wellbore 608 to a lateral wellbore 610.

Conventionally, tubings have been inserted through such milled openings of a casing into a lateral bore. The tubing typically has a smaller diameter than the lateral wellbore. Cement may be formed around the annulus region of the tubing inserted into lateral wellbore; however, an optimal seal is not always provided. In accordance with some embodiments of the invention, the highly deformable tubing or pipe 602 may be formed of a superplastic material that exhibits superplastic behavior at a desired elevated temperature. The tubing or pipe 602 having an initial reduced diameter is run through the window 604 of the casing or liner 606 into the lateral wellbore 610. Once properly positioned, an expander tool 612 may be run on a carrier line 614 into the inner bore of the tubing or pipe 602. The expander tool 612 is heated to an elevated temperature to heat the tubing or pipe 602 to a temperature at which the tubing or pipe 602 exhibits superplastic behavior. This makes expansion of the tubing or pipe 602 much easier, with structural integrity of the tubing or pipe 602 maintained because of the characteristics of a superplastic material. Once the tubing or pipe 602 in the lateral wellbore 610 has expanded to contact the inner surface of the lateral wellbore 610, a good seal may be provided at the junction of the main wellbore 608 and the lateral wellbore 610.

Figure 12:
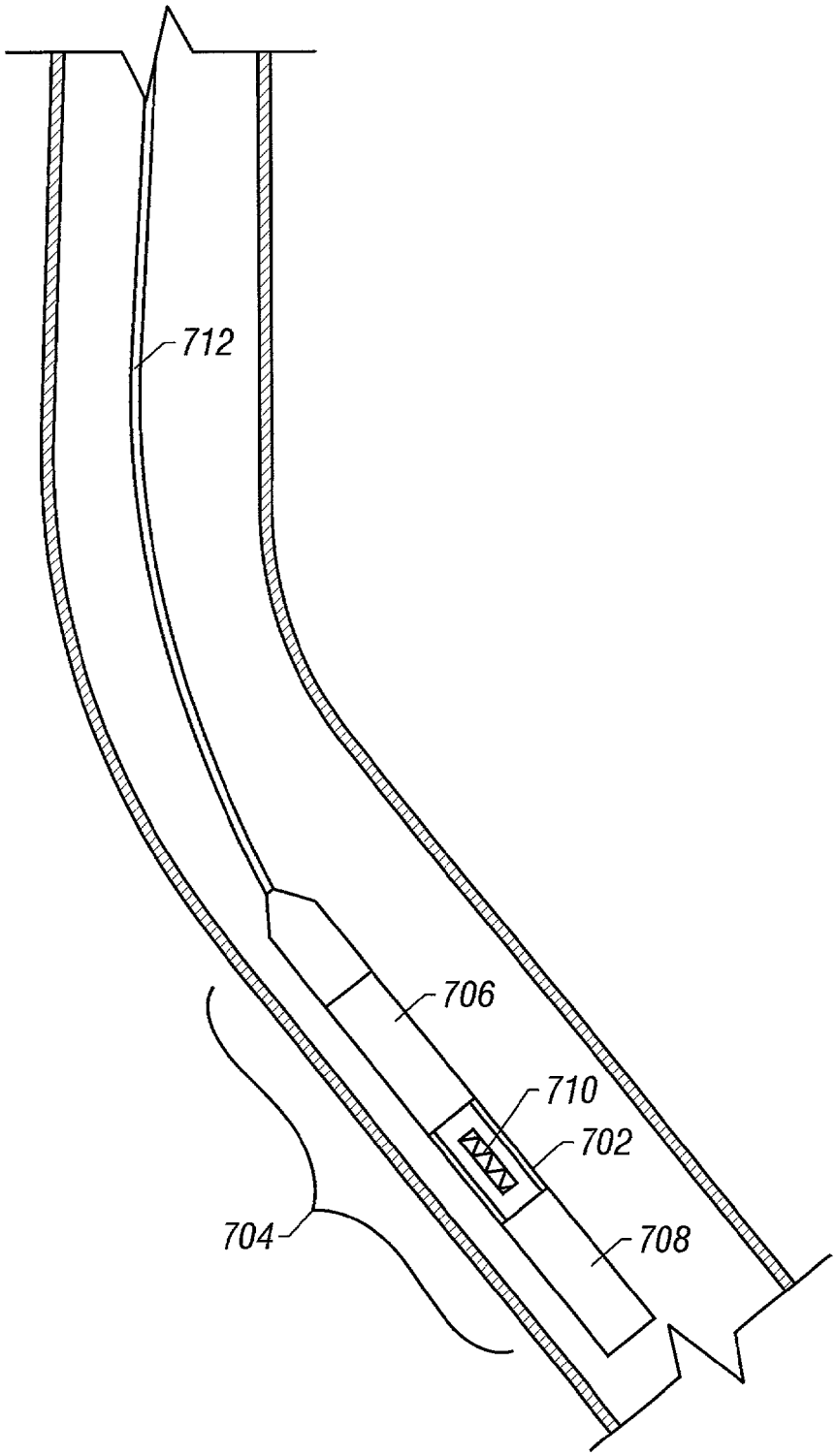
FIG. 12 illustrates a tool string having a shock absorber in accordance with an embodiment.

Referring to FIG. 12, in another embodiment, a highly deformable material may be used to form part of a shock absorber 702 in a tool string 704. The tool string 704 may include a first component 706 and a second component 708. It may be desirable to protect the first component 706 (which may be a gyroscope or some other sensitive equipment) from shock generated by the second component 708 (which may be an explosive device, such as a perforating gun). The shock absorber 702 includes a heating element 710 that is activated to an elevated temperature to cause a material in the shock absorber 702 to become highly deformable, which in one embodiment becomes superplastic.

Thus, in operation, the tool string 704 is lowered to a desired depth at which the second component 708 is to be activated. For example, if the second component 708 is a perforating gun, then a perforating operation may be performed at the desired depth to create openings in the surrounding casing and formation. Before activation of the perforating gun 708, the heating element 710 is activated, such as by an electrical signal conducted through a cable 712. This causes a superplastic material in the shock absorber 702 to exhibit superplastic characteristics, which provides superior shock absorbing characteristics to protect the sensitive components 706 from shock generated when the perforating gun 708 is activated.

Figure 13:
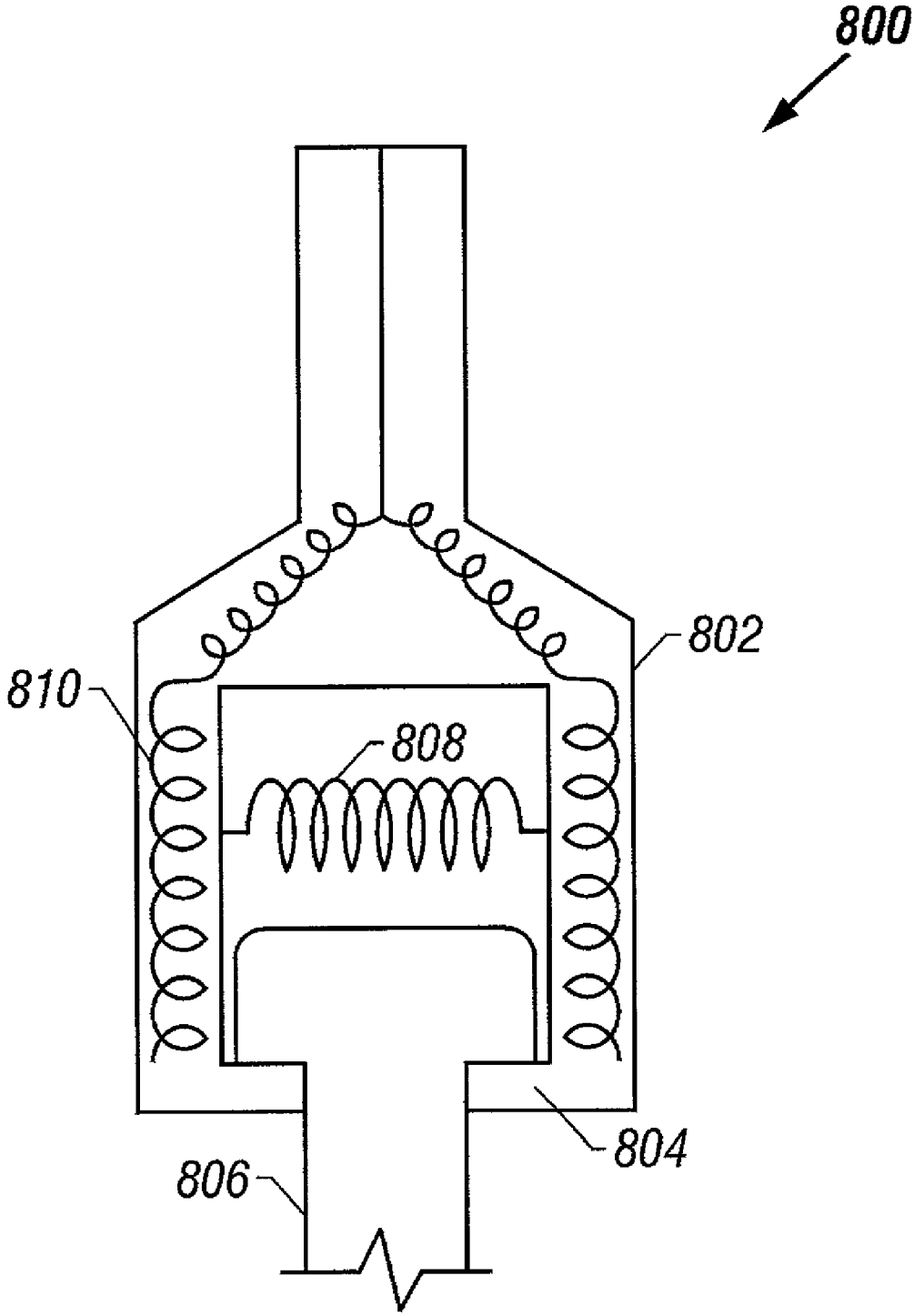
FIG. 13 illustrates a releasable connector assembly in accordance with an embodiment.

In another embodiment, as shown in FIG. 13, a release mechanism 800 includes a connector sub 802 that may be formed at least in part of a highly deformable material, such as a superplastic material. The connector member 802 includes a protruding portion 804 that is adapted to be engaged to another member 806. The strength of the connector member 802 when it is at a lower temperature is sufficient to maintain connection between the connector member 802 and the member 806, despite the presence of a spring 808 applying a radially outward force against the inner walls of the connector member 802. However, when release of the connector member 802 and the member 806 is desired, a resistive heating element 810 may be activated to heat up the connector member 802. If the connector member 802 includes a superplastic material, heating of the material to an elevated temperature may cause the connector member 802 to exhibit superplastic behavior. As a result, the force applied by the spring 808 becomes sufficient to push the connector member 802 apart to release the member 806.

Figure 14:
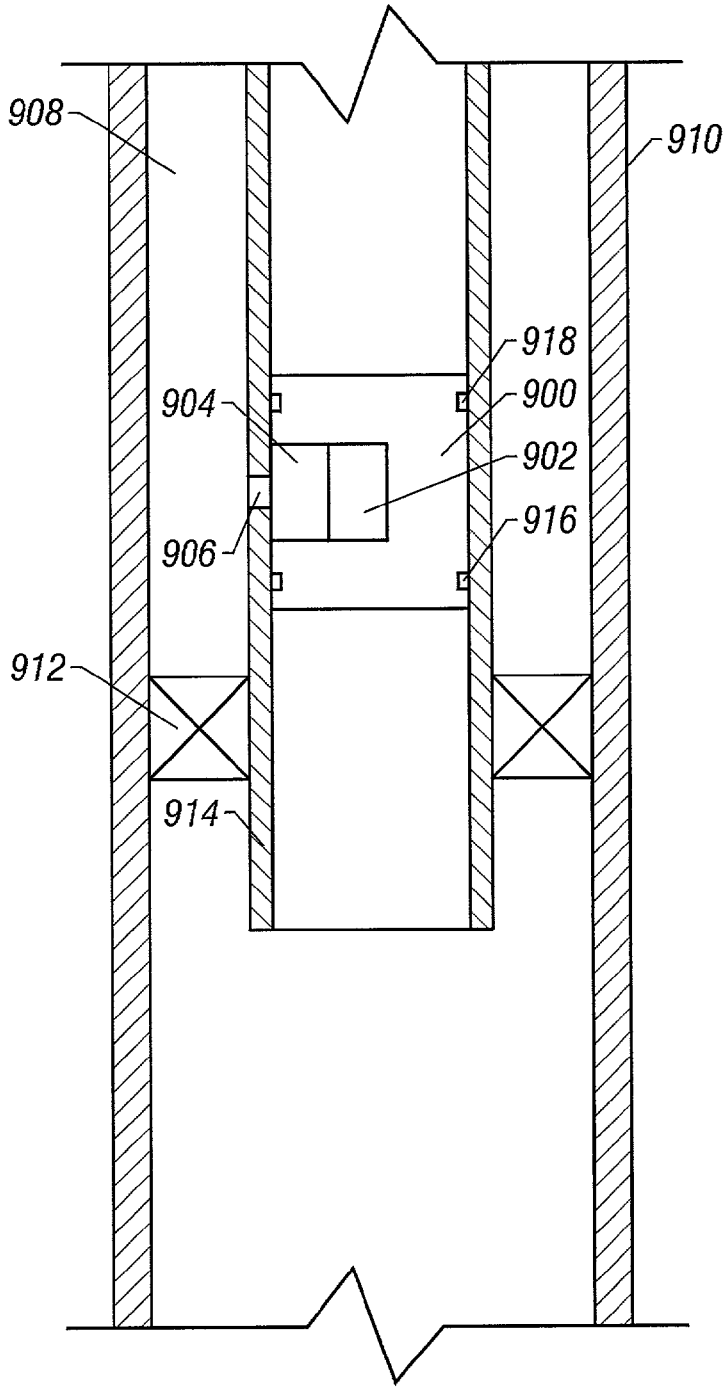
FIG. 14 illustrates a removable plug in accordance with an embodiment.

Referring to FIG. 14, a removable isolation plug 900 in accordance with an embodiment is illustrated. As shown in FIG. 14, the removable plug 900 is adapted for use at the lower end of a tubing 914, which may be a production tubing, as an example, which is positioned inside a casing or liner 910. First and second O-ring seals 916 and 918 may be placed around the plug 900 to isolate one side of the plug 900 from the other side in the bore of the tubing 914. A packer 912 is placed between the tubing 914 and the casing or liner 910 to isolate an annulus region 908. Fluid pressure in the annulus region 908 may be communicated through a port 906 to an activating mechanism 904. The activating mechanism 904 is associated with a local heat source 902, which may be an exothermic heat source.

The plug 900 may be formed of a highly deformable material when its temperature is raised to an elevated level. In one example, such a highly deformable material includes superplastic material. To remove the plug 900, fluid pressure is applied in the annulus region 908 and communicated through the port 906 to the activating mechanism 904. This activates the exothermic heat source 902, which heats up the plug 900 to a predetermined temperature range. When that occurs, the plug 900 begins to exhibit superplastic behavior, which enables the elevated fluid pressure communicated through the port 906 to deform the plug 900 radially inwardly. Deformation of the plug 900 in a radially contracting fashion allows the plug 900 to drop through the tubing 914 to the lower end of the wellbore. An isolation plug that can be removed using an interventionless technique may thus be employed.

Figure 15:
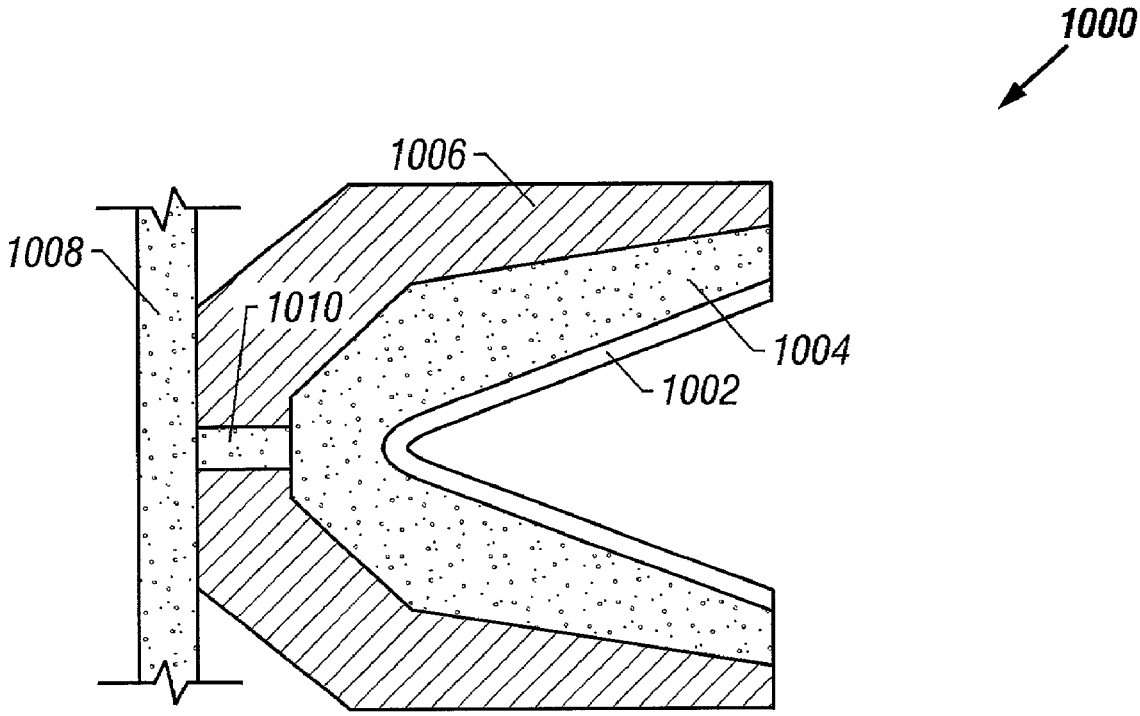
FIG. 15 is a cross-sectional view of shaped charge in accordance with an embodiment.

Referring to FIG. 15, a shaped charge 1000 includes a liner 1002 that is formed of a highly deformable material, which may be a superplastic material. The liner 1002 is placed adjacent an explosive charge 1004, which is contained inside a container 1006. A detonation wave traveling through a detonating cord 1008 is communicated through a primer 1010 to the explosive charge 1004. Detonation of the explosive charge 1004 causes the liner 1002 to collapse into a perforating jet that is useful for creating perforations in the surrounding casing or liner and the formation.

Figure 16:
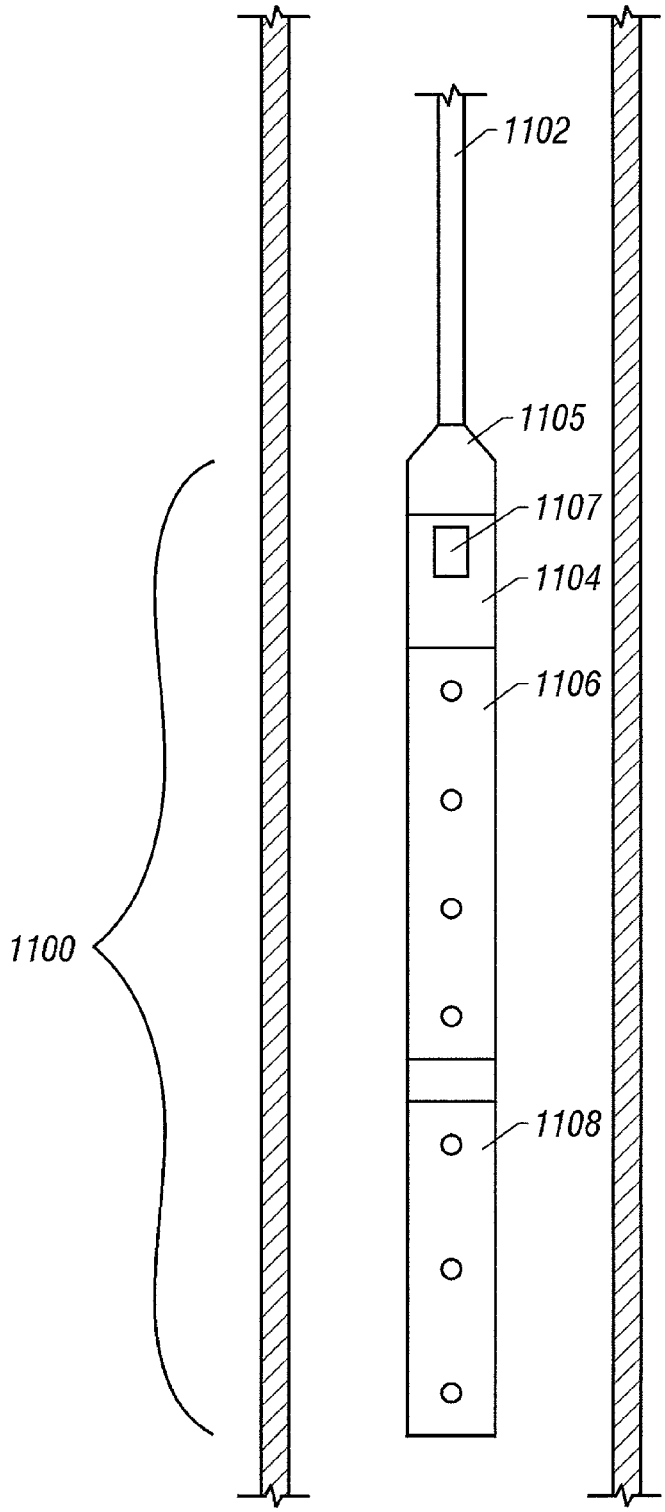
FIG. 16 illustrates a tool string including a weak point connector in accordance with an embodiment.

Referring to FIG. 16, a tool 1100 in accordance with another embodiment includes a weak point connector 1104 formed at least in part of a highly deformable material such as a superplastic material. The weak point connector 1104 is connected to an adapter 1105, which in turn is coupled to a carrier line 1102. The weak point connector 1104 is connected to a string of perforating guns 1106, 1108, and so forth.

The weak point connector 1104 is provided in case the gun string 1100 is stuck as it is being lowered into or removed from the wellbore. Conventionally, a weak point is provided to enable retrieval of at least a part of the run-in tool string when it becomes stuck. When the weak point breaks, the perforating guns (or other tools) drop to the bottom of the wellbore while the carrier line can be retrieved from the surface. However, such weak points may also break during perforating operations due to the shock generated by perforating guns.

By using a weak point connector 1104 that is formed of a highly deformable material, superior structural integrity may be provided so that the gun string does not break when the perforating guns are fired. In operation, a heating element 1107 in the weak point connector 1104 is activated to heat the weak point connector 1104 so that it exhibits superplastic behavior. The perforating guns 1106 and 1108 are then fired, which may cause a shock that may deform or bend the weak point connector 1104 without breaking it. As a result, the whole string of guns may be retrieved back to the surface, with some components re-used.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

THIS IS THE GENERAL LIST OF ARCONIUM ALLOYS. CUSTOM ALLOYS/FORMULATIONS ARE AVAILABLE TO SUIT YOUR SPECIAL REQUIREMENTS.

| Ostalloy | Temperature ° F. | | | Temperature ° C. | | | | Density | |
|---|---|---|---|---|---|---|---|---|---|
| Number | Solidus | | Liquidus | Solidus | | Liquidus | Alloy | $lb \cdot in^{-3}$ | $g \cdot cm^{-3}$ |
| 51 | 51 | E | 51 | 10.7 | E | 10.7 | 62.5 Ga, 21.5 In, 16 Sn | .2348 | 6.50 |
| 60 | 60 | E | 60 | 15.7 | E | 15.7 | 75.5 Ga, 24.5 In | .2294 | 6.35 |
| 117 | 117 | E | 117 | 47 | E | 47 | 44.7 Bi, 22.6 Pb, 19.1 In 8.3 Sn, 5.3 Cd | .3307 | 9.16 |
| 129133 | 129 | | 133 | 54 | | 56 | 49.3 Bi, 20.8 In, 17.9 Pb, 11.5 Sn, .5 Cd | .3253 | 9.01 |
| 134149 | 134 | | 149 | 57 | | 65 | 47.5 Bi, 25.4 Pb, 12.6 Sn, 9.5 Cd, 5 In | .3419 | 9.47 |
| 136 | 136 | E | 136 | 58 | E | 58 | 49 Bi, 21 In, 18 Pb, 12 Sn | .3253 | 9.00 |
| 136156 | 136 | | 156 | 58 | | 69 | 49 Bi, 18 Pb, 18 In, 15 Sn | .3249 | 9.00 |
| 142149 | 142 | | 149 | 61 | | 65 | 48 Bi, 25.7 Pb, 12.7 Sn, 9.6 Cd, 4 In | .3429 | 9.50 |
| 143 | 143 | E | 143 | 61.5 | E | 61.5 | 61.72 In, 30.78 Bi, 7.5 Cd | .2895 | 9.01 |
| 156158 | 156 | | 158 | 68 | | 69 | 52 Bi, 26 Pb, 22 In | .3450 | |
| 158 | 158 | E | 158 | 70 | E | 70 | 49.5 Bi, 27.3 Pb, 13.1 Sn, 10.1 Cd | .3458 | 9.58 |
| 158165A | 158 | | 165 | 70 | | 73 | 50.5 Bi, 27.8 Pb, 12.4 Sn, 9.3 Cd | .3491 | 9.67 |

-continued

THIS IS THE GENERAL LIST OF ARCONIUM ALLOYS. CUSTOM ALLOYS/FORMULATIONS ARE AVAILABLE TO SUIT YOUR SPECIAL REQUIREMENTS.

| Ostalloy | Temperature ° F. | | | Temperature ° C. | | | | Density | |
|---|---|---|---|---|---|---|---|---|---|
| Number | Solidus | | Liquidus | Solidus | | Liquidus | Alloy | lb · in$^{-3}$ | g · cm$^{-3}$ |
| 158173 | 158 | | 173 | 70 | | 78 | 50 Bi, 34.5 Pb, 9.3 Sn, 6.2 Cd | .3579 | 9.89 |
| 158194 | 158 | | 194 | 70 | | 90 | 42.5 Bi, 37.7 Pb, 11.3 Sn, 8.5 Cd | .3541 | 9.81 |
| 160190 | 160 | | 190 | 71 | | 88 | 42 Bi, 37 Pb, 12 Sn, 9 Cd | .3541 | 9.81 |
| 162 | 162 | E | 162 | 72 | E | 72 | 66.3 In, 33.7 Bi | .2886 | 7.99 |
| 165200 | 165 | | 200 | 73 | | 93 | 50 Bi, 39 Pb, 7 Cd, 4 Sn | .3650 | 10.11 |
| 170180 | 170 | | 180 | 77 | | 82 | 50 Bi, 39 Pb, 8 Cd, 3 Sn | .6570 | 10.13 |
| 171 | 171 | E | 171 | 77.5 | E | 77.5 | 48.5 Bi, 41.5 In, 10 Cd | .3066 | 8.49 |
| 178 | 178 | E | 178 | 81 | E | 81 | 54.1 Bi, 29.6 In, 16.3 Sn | .3058 | 8.47 |
| 178185 | 178 | | 185 | 81 | | 85 | 50.4 Bi, 39.2 Pb, 8 Cd, 1.4 In, 1 Sn | .3664 | 9.80 |
| 190200 | 190 | | 200 | 87 | | 93 | 51.45 Bi, 31.35 Pb, 15.2 Sn, 1 In | .3480 | 9.64 |
| 197 | 197 | E | 197 | 92 | E | 92 | 51.6 Bi, 40.2 Pb, 8.2 Cd | .3700 | 10.25 |
| 200 | 200 | E | 200 | 93 | E | 93 | 44 In, 42 Sn, 14 Cd | .2693 | 7.46 |
| 200210 | 200 | | 210 | 93 | | 99 | 50 Bi, 31 Pb, 19 Sn | .3458 | 9.58 |
| 202 | 202 | E | 202 | 95 | E | 95 | 52 Bi, 30 Pb, 18 Sn | .3465 | 9.60 |
| 203204 | 203 | | 204 | 95 | | 95.5 | 52 Bi, 32 Pb, 16 Sn | .3500 | 9.69 |
| 203219A | 203 | | 219 | 95 | | 104 | 56 Bi, 22 Pb, 22 Sn | .3382 | 9.37 |
| 203219B | 203 | | 219 | 95 | | 104 | 50 Bi, 30 Pb, 20 Sn | .3440 | 9.53 |
| 203219C | 203 | | 219 | 95 | | 104 | 46.1 Bi, 19.7 Pb, 34.2 Sn | .3270 | 9.06 |
| 203239 | 203 | | 239 | 95 | | 115 | 50 Bi, 25 Pb, 25 Sn | .3364 | 9.32 |
| 203264 | 203 | | 264 | 95 | | 129 | 51.6 Bi, 37.4 Sn, 6 In, 5 Pb | .3097 | 8.58 |
| 203277 | 203 | | 277 | 95 | | 136 | 36 Bi, 32 Pb, 31 Sn, 1 Ag | .3328 | 9.22 |
| 205225 | 205 | | 225 | 96 | | 107 | 45 Bi, 35 Pb, 20 Sn | .3465 | 9.60 |
| 205271 | 205 | | 271 | 96 | | 133 | 34 Pb, 34 Sn, 32 Bi | .3303 | 9.15 |
| 208221 | 208 | | 221 | 98 | | 105 | 52.2 Bi, 37.8 Pb, 10 Sn | .3599 | 9.97 |
| 208234 | 208 | | 234 | 98 | | 112 | 51.6 Bi, 41.4 Pb, 7 Sn | .3657 | 10.13 |
| 212 | 212 | E | 212 | 100 | E | 100 | 35.7 Sn, 35.7 Bi, 28.6 Pb | .3370 | 9.34 |
| 215226 | 215 | | 226 | 102 | | 108 | 54.5 Bi, 39.5 Pb, 6 Sn | .3660 | 10.14 |
| 219 | 219 | E | 219 | 104 | E | 104 | 53.9 Bi, 25.9 Sn, 20.2 Cd | .3111 | 8.67 |
| 229 | 229 | E | 229 | 109 | E | 109 | 67 Bi, 33 In | .3180 | 8.81 |
| 242248 | 242 | | 248 | 117 | | 120 | 55 Bi, 44 Pb, 1 Sn | .3751 | 10.39 |
| 244 | 244 | E | 244 | 118 | E | 118 | 52 In, 48 Sn | .2635 | 7.30 |
| 244257 | 244 | | 257 | 118 | | 125 | 50 In, 50 Sn | .2635 | 7.30 |
| 244268 | 244 | | 268 | 118 | | 131 | 52 Sn, 48 In | .2635 | 7.30 |
| 244293 | 244 | | 293 | 118 | | 145 | 58 Sn, 42 In | .2635 | 7.30 |
| 248250 | 248 | | 250 | 120 | | 121 | 55 Bi, 44 Pb, 1 In | .3751 | 10.38 |
| 248266 | 248 | | 266 | 120 | | 130 | 40 In, 40 Sn, 20 Pb | .2837 | 7.86 |
| 248306 | 248 | | 306 | 120 | | 152 | 42 Pb, 37 Sn, 21 Bi | .3307 | 9.16 |
| ○ 250277 | 250 | | 277 | 121 | | 136 | 55.1 Bi, 39.9 Sn, 5 Pb | .3130 | 8.67 |
| 253 | 253 | E | 253 | 123 | E | 123 | 74 In, 26 Cd | .2751 | 7.62 |
| • 255 | 255 | E | 255 | 124 | E | 124 | 55.5 Bi, 44.5 Pb | .3769 | 10.44 |
| • 255259 | 255 | | 259 | 124 | | 126 | 58 Bi, 42 Pb | .3754 | 10.40 |
| 257 | | MP | 257 | | MP | 125 | 70 In, 15 Sn, 9.6 Pb, 5.4 Cd | .2754 | 7.63 |
| 257302 | 257 | | 302 | 125 | | 150 | 95 In, 5 Bi | .2673 | 7.40 |
| 262269 | 262 | | 269 | 128 | | 132 | 75 In, 25 Sn | .2720 | 7.30 |
| ○ 262271 | 262 | | 271 | 128 | | 133 | 56.84 Bi, 41.16 Sn, 2 Pb | .3105 | 8.60 |
| 266343 | 266 | | 343 | 130 | | 173 | 50 Pb, 30 Sn, 20 Bi | .3419 | 9.47 |
| 268338 | 268 | | 338 | 131 | | 170 | 51.5 Pb, 27 Sn, 21.5 Bi | .3458 | 9.58 |
| 268375 | 268 | | 375 | 131 | | 190 | 80 In, 20 Sn | .2710 | 7.30 |
| 270282 | 270 | | 282 | 132 | | 139 | 45 Sn, 32 Pb, 18 Cd, 5 Bi | .3115 | 8.63 |
| ○ 275 | | MP | 275 | | MP | 135 | 57.4 Br, 41.6 Sn, 1 Pb | .3097 | 8.58 |
| *281 | 281 | E | 281 | 138 | E | 138 | 58 Bi, 42 Sn | .3090 | 8.56 |
| *281299 | 281 | | 299 | 138 | | 148 | 50 Bi, 50 Sn | .2970 | 8.23 |
| *281333 | 281 | | 333 | 138 | | 167 | 43 Bi, 57 Sn | .2960 | 8.16 |
| *281338 | 281 | | 338 | 138 | | 170 | 60 Sn, 40 Bi | .2931 | 8.12 |
| *284324 | 284 | | 324 | 140 | | 162 | 48 Sn, 36 Pb, 16 Bi | .3170 | 8.78 |
| 291 | 291 | E | 291 | 144 | E | 144 | 60 Bi, 40 Cd | .3361 | 9.31 |
| 291295 | 291 | | 295 | 144 | | 163 | 90 In, 10 Sn | .2710 | 7.51 |
| • 291325 | 291 | | 325 | 144 | | 163 | 43 Pb, 43 Sn, 14 Bi | .3245 | 8.99 |
| 293 | 293 | E | 293 | 145 | E | 145 | 51.2 Sn, 30.6 Pb, 18.2 Cd | .3050 | 8.45 |
| 293325 | 293 | | 325 | 145 | | 162 | 75 In, 25 Pb | .2830 | 7.84 |
| 296 | 296 | E | 296 | 146 | E | 146 | 97 In, 3 Ag | .2664 | 7.38 |
| 298300 | 298 | | 300 | 148 | | 149 | 80 In, 15 Pb, 5 Ag | .2834 | 7.85 |
| 307A | | MP | 307 | | MP | 153 | 99.5 In, .5 Ga | .2639 | 7.31 |
| 307322 | 307 | | 322 | 153 | | 161 | 70 Sn, 18 Pb, 12 In | .2812 | 7.79 |
| 313 | | MP | 313 | | MP | 156.7 | 100 In | .2639 | 7.31 |
| 320345 | 320 | | 345 | 160 | | 174 | 70 In, 30 Pb | .2956 | 8.19 |
| *338 | 338 | E | 338 | 170 | E | 170 | 65.5 Sn, 31.5 Bi, 3.0 In | .2901 | 8.03 |
| 345365 | 345 | | 365 | 174 | | 185 | 60 In, 40 Pb | .3077 | 8.52 |
| 348 | 348 | E | 348 | 176 | E | 176 | 67.8 Sn, 32.2 Cd | .2772 | 7.68 |
| 355 | 355 | E | 355 | 179 | E | 179 | 62 Sn, 36 Pb, 2 Ag | .3036 | 8.41 |
| 355410 | 355 | | 410 | 179 | | 210 | 55 Pb, 44 Sn, 1 Ag | .3289 | 9.10 |
| 355450 | 355 | | 450 | 179 | | 232 | 60 Pb, 37 Sn, 3 Ag | .3390 | 9.39 |

-continued

THIS IS THE GENERAL LIST OF ARCONIUM ALLOYS. CUSTOM ALLOYS/FORMULATIONS ARE AVAILABLE TO SUIT YOUR SPECIAL REQUIREMENTS.

| Ostalloy | Temperature ° F. | | | Temperature ° C. | | | | Density | |
|---|---|---|---|---|---|---|---|---|---|
| Number | Solidus | | Liquidus | Solidus | | Liquidus | Alloy | $lb \cdot in^{-3}$ | $g \cdot cm^{-3}$ |
| 355500 | 355 | | 500 | 179 | | 260 | 50 Sn, 47 Pb, 3 Ag | .3198 | 8.86 |
| 356408 | 356 | | 408 | 180 | | 209 | 50 In, 50 Pb | .3198 | 8.86 |
| 361 | 361 | E | 361 | 183 | E | 183 | 63 Sn, 37 Pb | .3032 | 8.40 |
| 361367 | 361 | | 367 | 183 | | 186 | 70 Sn, 30 Pb | .2946 | 8.16 |
| 361370 | 361 | | 370 | 183 | | 188 | 60 Sn, 40 Pb | .3068 | 8.50 |
| 361378 | 361 | | 378 | 183 | | 192 | 75 Sn, 25 Pb | .2888 | 8.00 |
| 361390 | 361 | | 390 | 183 | | 199 | 80 Sn, 20 Pb | .2834 | 7.85 |
| 361403 | 361 | | 403 | 183 | | 205 | 85 Sn, 15 Pb | .2780 | 7.70 |
| 361413 | 361 | | 413 | 183 | | 212 | 50 Sn, 50 Pb | .3202 | 8.87 |
| 361415 | 361 | | 415 | 183 | | 213 | 90 Sn, 10 Pb | .2726 | 7.55 |
| 361432 | 361 | | 432 | 183 | | 222 | 95 Sn, 5 Pb | .2679 | 7.42 |
| 361460 | 361 | | 460 | 183 | | 238 | 60 Pb, 40 Sn | .3350 | 9.28 |
| 361496 | 361 | | 496 | 183 | | 257 | 70 Pb, 30 Sn | .3509 | 9.72 |
| 361514 | 361 | | 514 | 183 | | 268 | 75 Pb, 25 Sn | .3595 | 9.96 |
| 380450 | 380 | | 450 | 193 | | 232 | 65 Pb, 35 In | .3420 | 9.47 |
| 383437 | 383 | | 437 | 195 | | 225 | 60 Pb, 40 In | .3350 | 9.30 |
| 390 | 390 | E | 390 | 199 | E | 199 | 91 Sn, 9 In | .2626 | 7.27 |
| 422 | 422 | E | 422 | 217 | E | 217 | 90 Sn, 10 Au | .2730 | 7.30 |
| 430 | 430 | E | 430 | 221 | E | 221 | 96.5 Sn, 3.5 Ag | .2657 | 7.36 |
| 430448 | 430 | | 448 | 221 | | 238 | 96 Sn, 4 Ag | .2640 | 7.31 |
| 430465 | 430 | | 465 | 221 | | 240 | 95 Sn, 5 Ag | .2668 | 7.39 |
| 430563 | 430 | | 563 | 221 | | 295 | 90 Sn, 10 Ag | .2711 | 7.51 |
| 450 | | MP | 450 | | MP | 232 | 100 Sn | .2628 | 7.28 |
| 450456 | 450 | | 456 | 232 | | 235 | 98 Sn, 2 Sb | .2690 | 7.45 |
| 450464 | 450 | | 464 | 232 | | 240 | 95 Sn, 5 Sb | .2617 | 7.25 |
| 451 | | MP | 451 | | MP | 233 | 65 Sn, 25 Ag, 10 Sb | .2818 | 7.80 |
| 463470 | 463 | | 470 | 239 | | 243 | 85 Pb, 10 Sb, 5 Sn | .3820 | 10.58 |
| 463545 | 463 | | 545 | 239 | | 285 | 92 Pb, 5 Sn, 3 Sb | .3906 | 10.82 |
| 482508 | 482 | | 508 | 250 | | 264 | 75 Pb, 25 In | 3599 | 9.97 |
| 486500 | 486 | | 500 | 252 | | 260 | 90 Pb, 10 Sb | .3826 | 10.60 |
| 514570 | 514 | | 570 | 268 | | 299 | 88 Pb, 10 Sn, 2 Ag | .3887 | 10.77 |
| 518536 | 518 | | 536 | 270 | | 280 | 81 Pb, 19 In | .3707 | 10.27 |
| 520 | | MP | 520 | | MP | 271 | 100 Bi | .3541 | 9.80 |
| 522603 | 522 | | 603 | 273 | | 316 | 96 Pb, 4 Sn | .3930 | 10.87 |
| 524564 | 524 | | 564 | 274 | | 296 | 95 Bi, 5 Sb | .3445 | 9.54 |
| 527576 | 527 | | 576 | 275 | | 302 | 90 Pb, 10 Sn | .3881 | 10.75 |
| 529553 | 529 | | 553 | 277 | | 290 | 85 Pb, 15 In | .3795 | 10.51 |
| 536 | 536 | E | 536 | 280 | E | 280 | 80 Au, 20 Sn | .5242 | 14.51 |
| 536558 | 536 | | 558 | 280 | | 292 | 90 Pb, 10 In | .3870 | 10.72 |
| 549565 | 549 | | 565 | 287 | | 296 | 92.5 Pb, 5 Sn, 2.5 Ag | .3978 | 11.02 |
| 554590 | 554 | | 590 | 290 | | 310 | 90 Pb, 5 In, 5 Ag | .3971 | 11.00 |
| 558 | | MP | 558 | | MP | 292 | 90 Pb, 5 Ag, 5 Sn | .3971 | 11.00 |
| 558598 | 558 | | 598 | 292 | | 314 | 95 Pb, 5 In | .3980 | 11.06 |
| 570580 | 570 | | 580 | 299 | | 304 | 95.5 Pb, 2.5 AG, 2 Sn | .4043 | 11.20 |
| 572 | | MP | 572 | | MP | 300 | 92.5 Pb, 5 In, 2.5 Ag | .3978 | 11.02 |
| 579 | 579 | E | 579 | 303 | E | 303 | 97.5 Pb, 2.5 Ag | .4090 | 11.33 |
| 581687 | 581 | | 687 | 305 | | 364 | 95 Pb, 5 Ag | .4079 | 11.30 |
| 588 | 588 | E | 588 | 309 | E | 309 | 97.5 Pb, 1.5 Ag, 1 Sn | .4072 | 11.28 |
| 590598 | 590 | | 598 | 310 | | 314 | 95 Pb, 5 Sn | .3980 | 11.06 |
| 590611 | 590 | | 611 | 310 | | 322 | 98.5 Pb, 1.5 Sb | .4054 | 11.23 |
| 597 | | MP | 597 | | MP | 313 | 91 Pb, 4 Sn, 4 Ag, 1 In | .4060 | 11.24 |
| 620 | | MP | 620 | | MP | 327 | 100 Pb | .4090 | 11.35 |

E = Eutectic
MP = Melting Point

What is claimed is:

1. An apparatus for use in a wellbore, comprising:

a carrier line; and a tool carried by the carrier line for deployment into the wellbore, comprising:

an element formed of a superplastic material to perform a predetermined downhole task; and a heating device to heat the element to a temperature sufficient to cause the element to exhibit superplastic behavior.

2. An apparatus for use in a wellbore, comprising:

an element formed of a superplastic material to perform a predetermined downhole task;

a component including a seal engagement with the element, wherein the element is adapted to translate the seal into engagement with a downhole structure; and a carrier line and a tool carried by the carrier line for deployment into the well, wherein the tool comprises the element formed of the superplastic material and the component including the seal, the tool further comprising a heating device to heat the superplastic material to a temperature such that the element exhibits superplastic behavior.

3. The apparatus of claim 2, further comprising a piston adapted to cause translation of the element.

4. An apparatus for use in a wellbore, comprising:

an element formed of a superplastic material to perform a predetermined downhole task;

a component including a seal engageable with the element, wherein the element is adapted to translate the seal into engagement with a downhole structure; and a heating device to heat the superplastic material to a temperature such that the element exhibits superplastic behavior, wherein the heating device comprises a propellant.

5. An apparatus for use in a wellbore, comprising:

a carrier line; and a tool carried by the carrier line for deployment into the wellbore, comprising:

an element formed of a superplastic material to perform a predetermined downhole task, wherein the element is selected from the group consisting of a casing, a liner, a tubing, and a pipe; and a heating device to heat the element to a temperature such that the element exhibits superplastic behavior.

6. An apparatus for use in a wellbore, comprising:

an element formed of a superplastic material to perform a predetermined downhole task;

wherein the element includes a sand screen; and a heating device to heat the sand screen to a temperature such that the sand screen exhibits superplastic behavior.

7. An apparatus for use in a wellbore, comprising:

an element formed of a superplastic material to perform a predetermined downhole task; and a heating device to heat the element to a temperature sufficient to cause the element to exhibit superplastic behavior, wherein the heating device comprises a propellant.

8. An apparatus for use in a wellbore, comprising:

an element formed of a superplastic material to perform a predetermined downhole task;

a junction seal assembly comprising the element; and a heating device to heat the element to a temperature sufficient to cause the element to exhibit superplastic behavior, wherein the heating device comprises a propellant.

9. The apparatus of claim 8, wherein the element comprises one of a tubing and pipe to be inserted into a lateral wellbore.

* * * * *